US005390801A

United States Patent [19]

Hansen

[11] Patent Number: 5,390,801

[45] Date of Patent: Feb. 21, 1995

[54] DOCUMENT HOLDER

[76] Inventor: Robert S. Hansen, P.O. Box 2238, Rohnert Park, Calif. 94928

[21] Appl. No.: 807,148

[22] Filed: Dec. 13, 1991

Related U.S. Application Data

[63] Continuation-in-part of Ser. No. 572,428, Aug. 27, 1990, abandoned, which is a continuation-in-part of Ser. No. 563,684, Dec. 20, 1983, Pat. No. 5,046,626.

[51] Int. Cl.[6] ..... B42F 11/00

[52] U.S. Cl. ..... 211/55; 211/131; 211/128; 211/88; 211/163; 248/441.1

[58] Field of Search ..... 211/55, 50, 56, 58, 211/128, 129, 131, 163, 194, 12, 10, 52; 312/183; 206/449, 425; 220/4 F, 4 C, 22.3, 229; 248/441.1, 447.1, 453, 454; 40/352, 354

[56] References Cited

U.S. PATENT DOCUMENTS 951,664 3/1910 Swan .
2,664,206 12/1953 Beal .
2,799,968 7/1957 Wythe ..... 248/454
4,062,452 12/1977 Bartholomew ..... 211/55
4,074,453 2/1978 Knox ..... 40/354 X
4,083,456 4/1978 Genn et al. .
4,267,656 5/1981 Solomon ..... 40/352

FOREIGN PATENT DOCUMENTS 857489 12/1960 United Kingdom .

*Primary Examiner*—Blair M. Johnson

[57] ABSTRACT

Document holder for holding one or more sheets of paper in a generally upright position having a curvilinear element which engages the underside of a vertically inclined sheet of paper in fulcrum-like fashion along a horizontally extending line no higher than the vertical centerline of the paper and imparts an upwardly concave curvature to the paper which enables the paper to extend for at least one-half of its length above the fulcrum without buckling under its own weight. The lower portion of the paper is held in a fixed position so that the paper does not rotate about the fulcrum due to the weight of the paper above the fulcrum. The embodiments disclosed include modular units for use on walls and other vertical surfaces, circular units with rotary bases for use on countertops and other horizontal surfaces and a copy holder for use on desks and the like.

22 Claims, 9 Drawing Sheets

DOCUMENT HOLDER

This is a continuation-in-part of Ser. No. 07/572,428, filed Aug. 27, 1990, now abandoned, a continuation-in-part of Ser. No. 06/563,684, filed Dec. 20, 1983, U.S. Pat. No. 5,046,626.

This invention pertains generally to document holders and, more particularly, to a document holder for holding one or more papers in a generally upright position.

The tendency of papers to buckle and collapse due to their own weight makes it difficult to hold them for display in an upright position. Consequently, papers are frequently stacked in piles on a horizontal surface or placed in racks in which no more than a small portion of each sheet is exposed. When stacked in piles, the papers may take up valuable counter space or other working surfaces, and when placed in a rack with only limited exposure, the papers are difficult to see without removing them at least partially from the rack.

It is in general an object of the invention to provide a new and improved document holder for holding papers in a generally upright position.

Another object of the invention is to provide a document holder of the above character in which a relatively large portion of each document is exposed to view.

These and other objects are achieved in accordance with the invention by providing a document holder having a curvilinear element Which engages the underside of a vertically inclined sheet of paper in fulcrum-like fashion along a horizontally extending line no higher than the vertical centerline of the paper and imparts an upwardly concave curvature to the paper which enables the paper to extend for at least one-half of its length above the fulcrum without buckling under its own weight. The lower portion of the paper is held in a fixed position so that the paper does not rotate about the fulcrum due to the weight of the paper above the fulcrum. The embodiments disclosed include modular units for use on walls and other vertical surfaces, circular units with rotary bases for use on countertops and other horizontal surfaces and a copy holder for use on desks and the like.

FIG. 1 a front elevational view of one embodiment of a document holder according to the invention.

Figure 1:
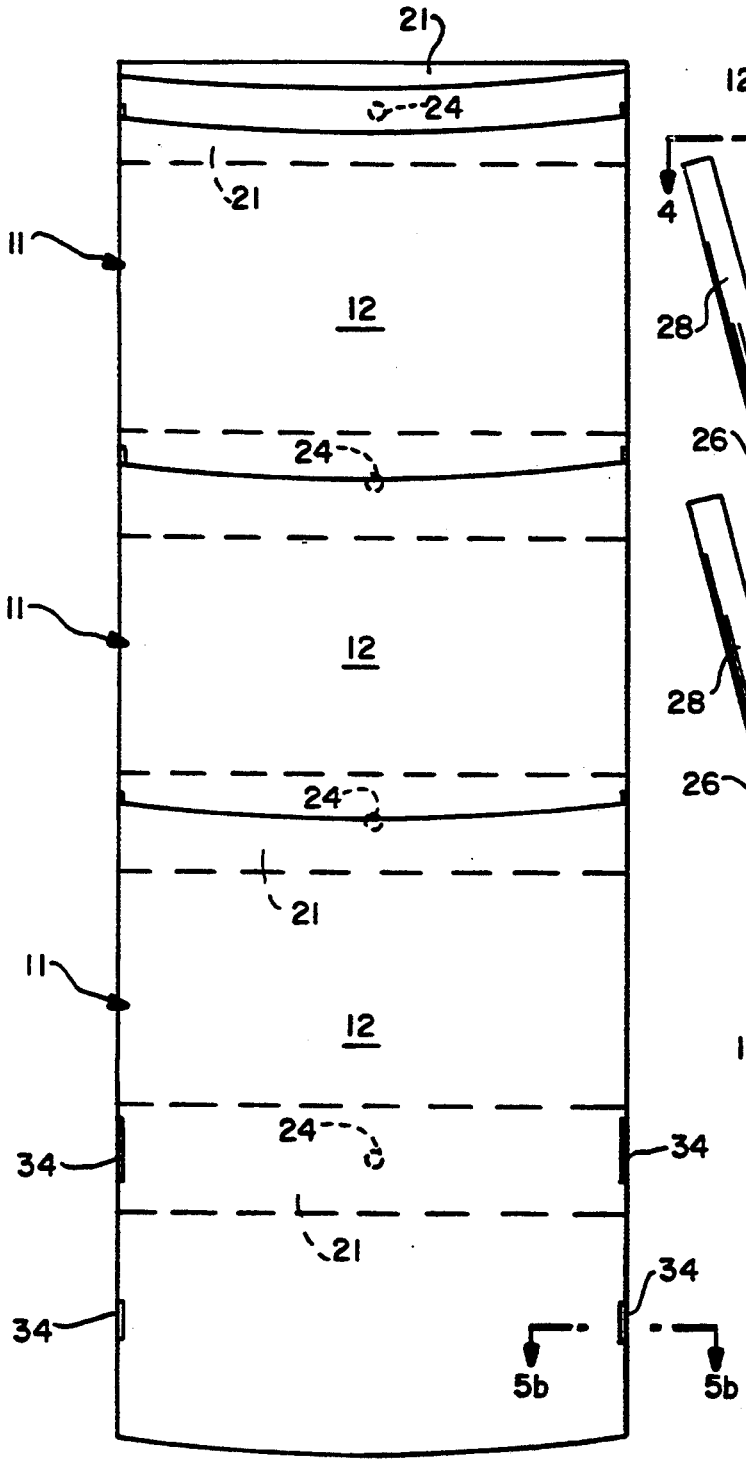
Figure 5B:
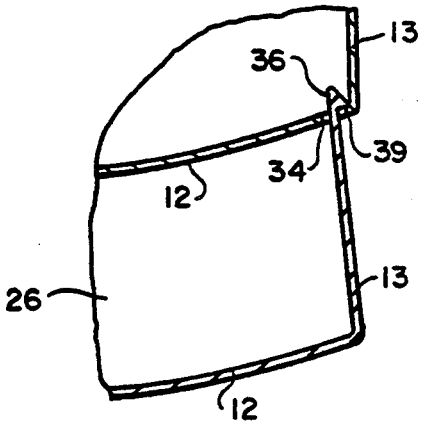
Figure 5A:
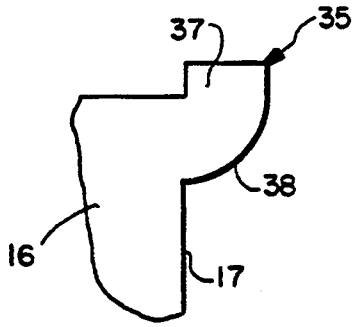
Figure 4:
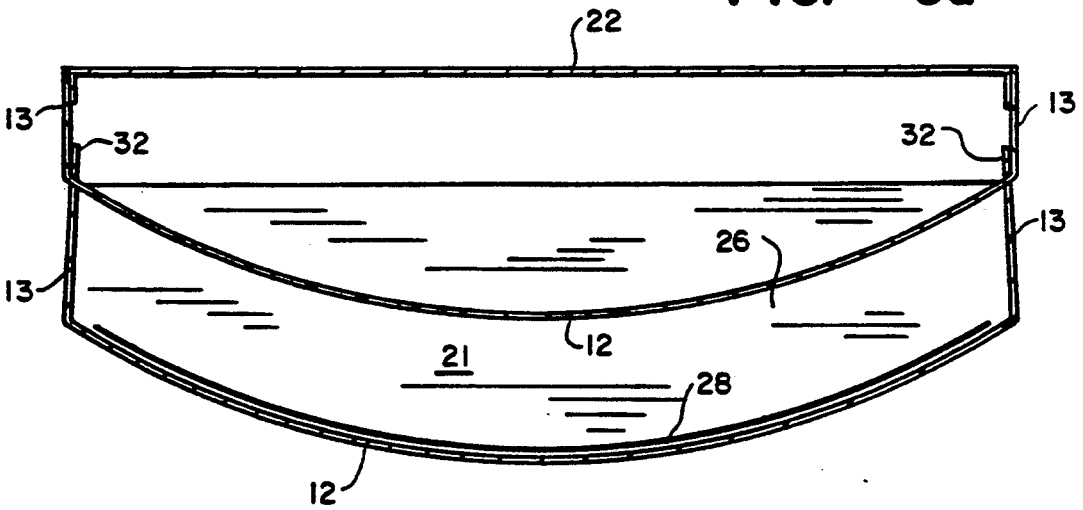
FIG. 4 is an enlarged cross-sectional view taken along line 4—4 in FIG. 2.

FIG. 5*a* is a fragmentary side elevational view illustrating an alternative connector for joining the modular units together in the embodiment of FIG. 1.

FIG. 5*b* is an enlarged fragmentary cross-sectional view taken along line 5*b*—5*b* in FIG. 1, illustrating another alternative connector for joining the modular units together.

Figure 6:
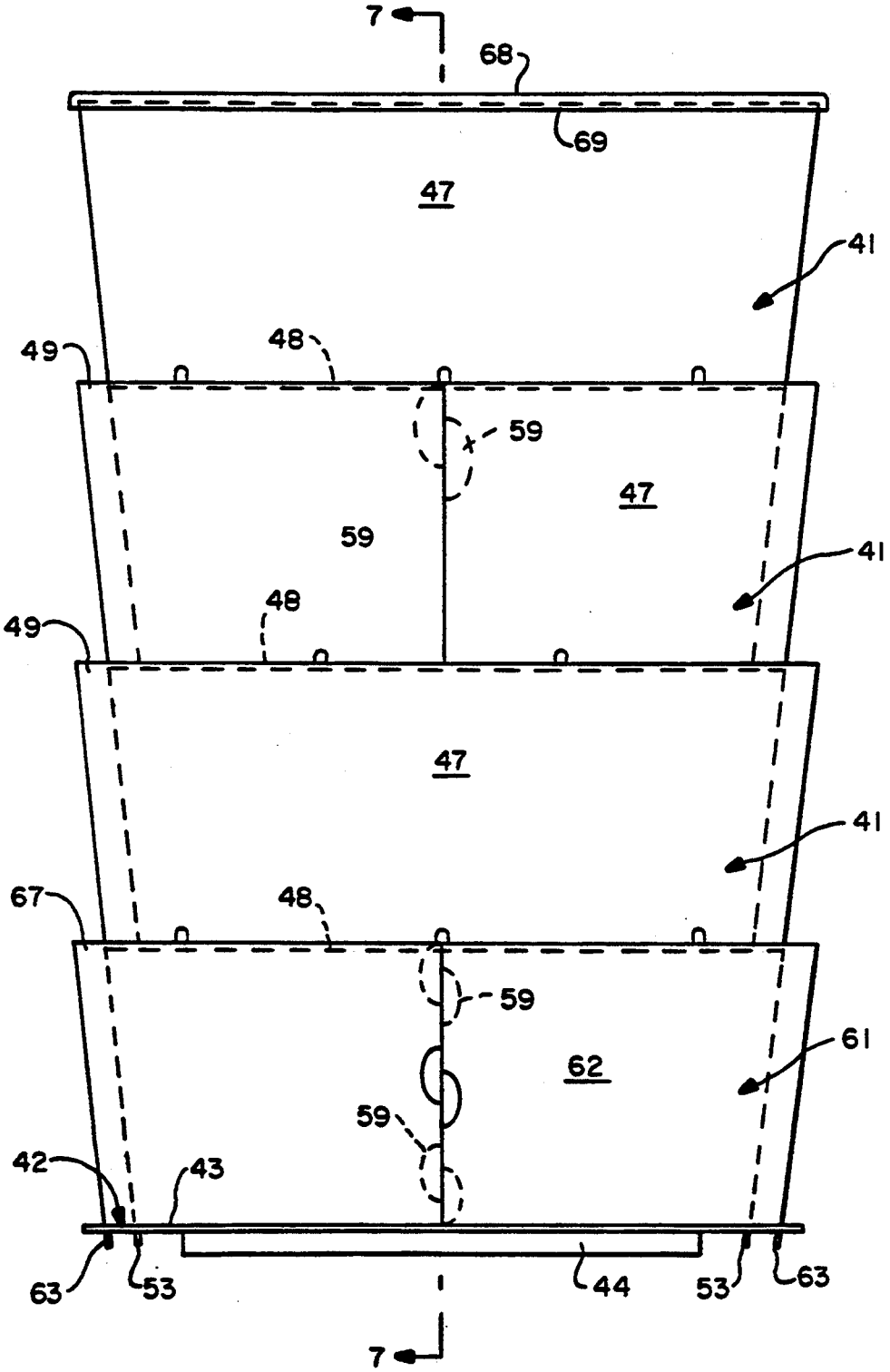

FIG. 6 is a side elevational view of another embodiment of a document holder according to the invention.

Figure 7:
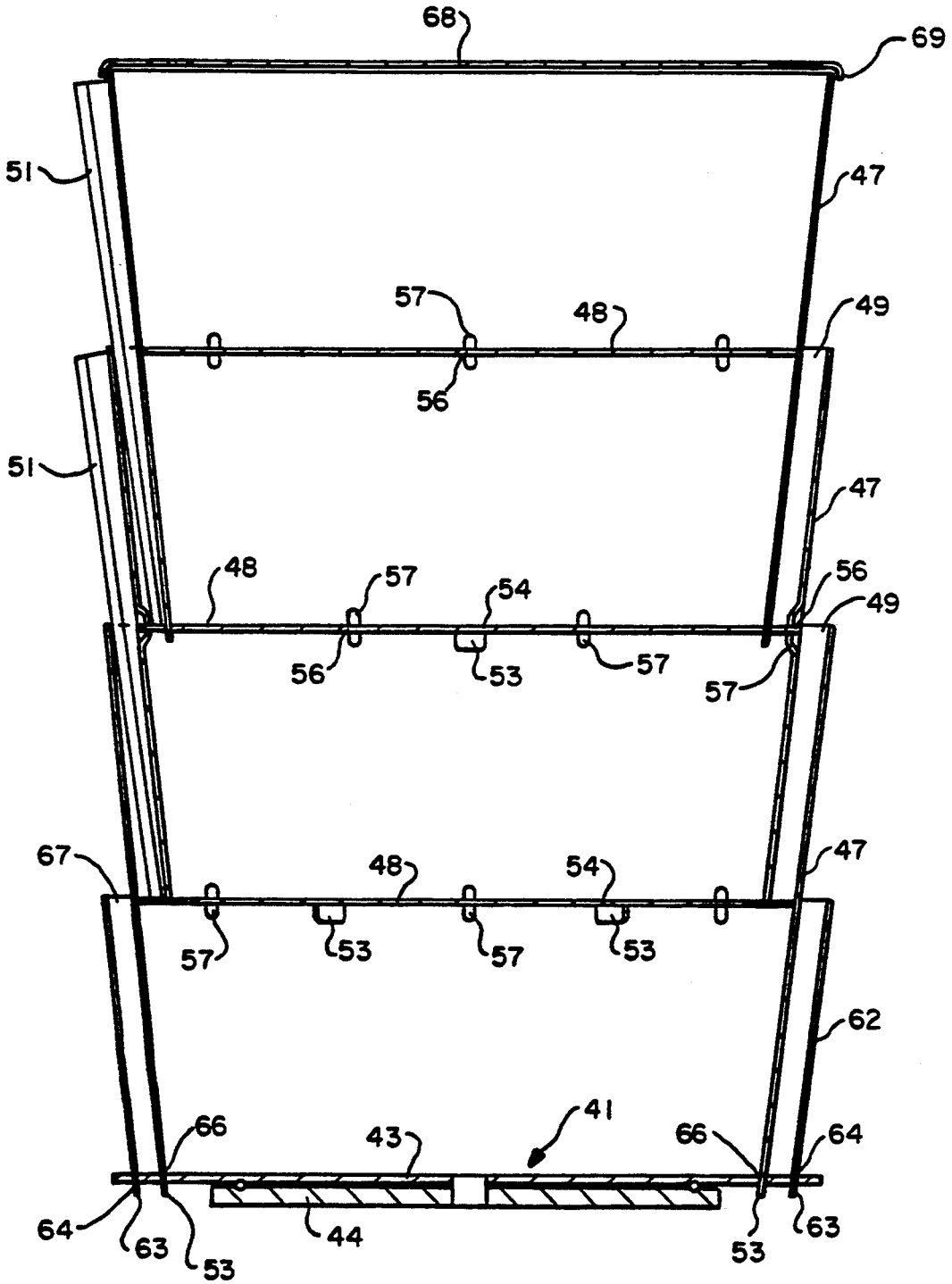

FIG. 7 is a cross-sectional view taken along line 7—7 in FIG. 6.

Figure 8:
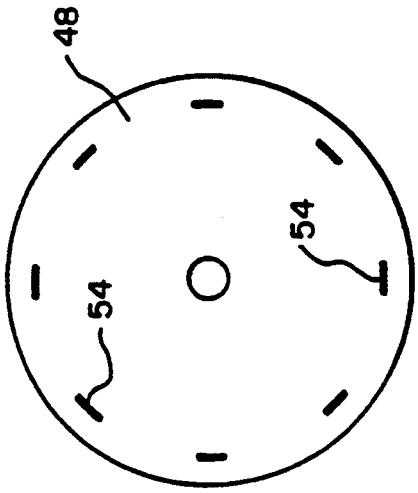

FIG. 8 is a plan view of one of the bottom wall members utilized in the embodiment of FIG. 6.

Figure 9:
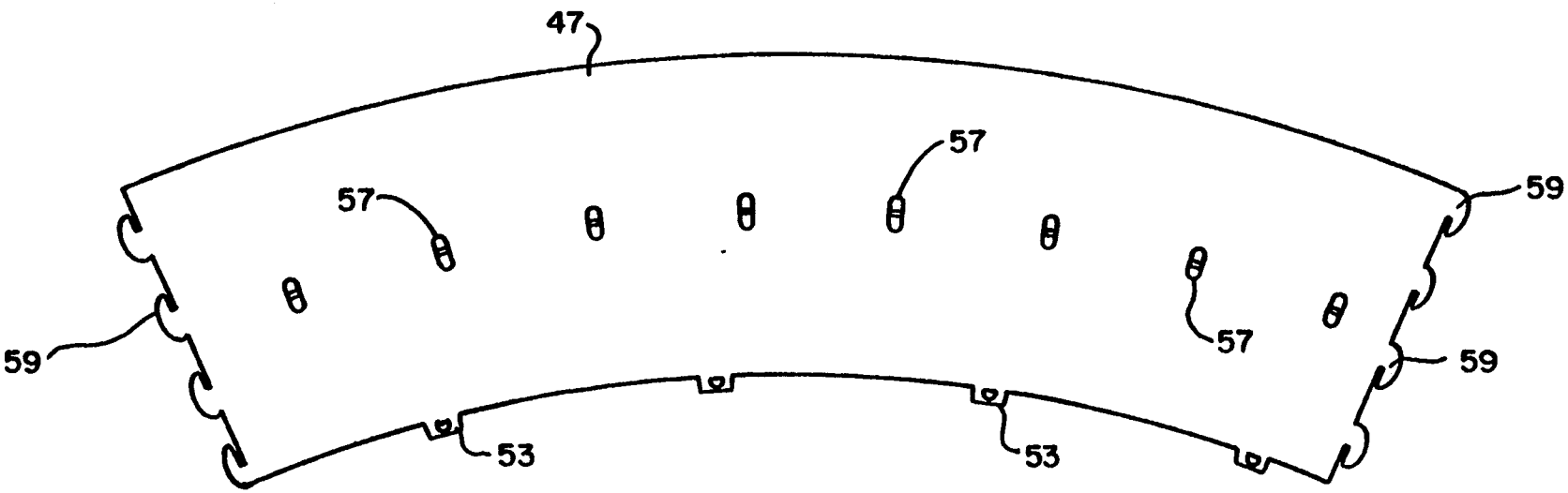

FIG. 9 is a plan view of one of the side wall members utilized in the embodiment of FIG. 6.

Figure 10:
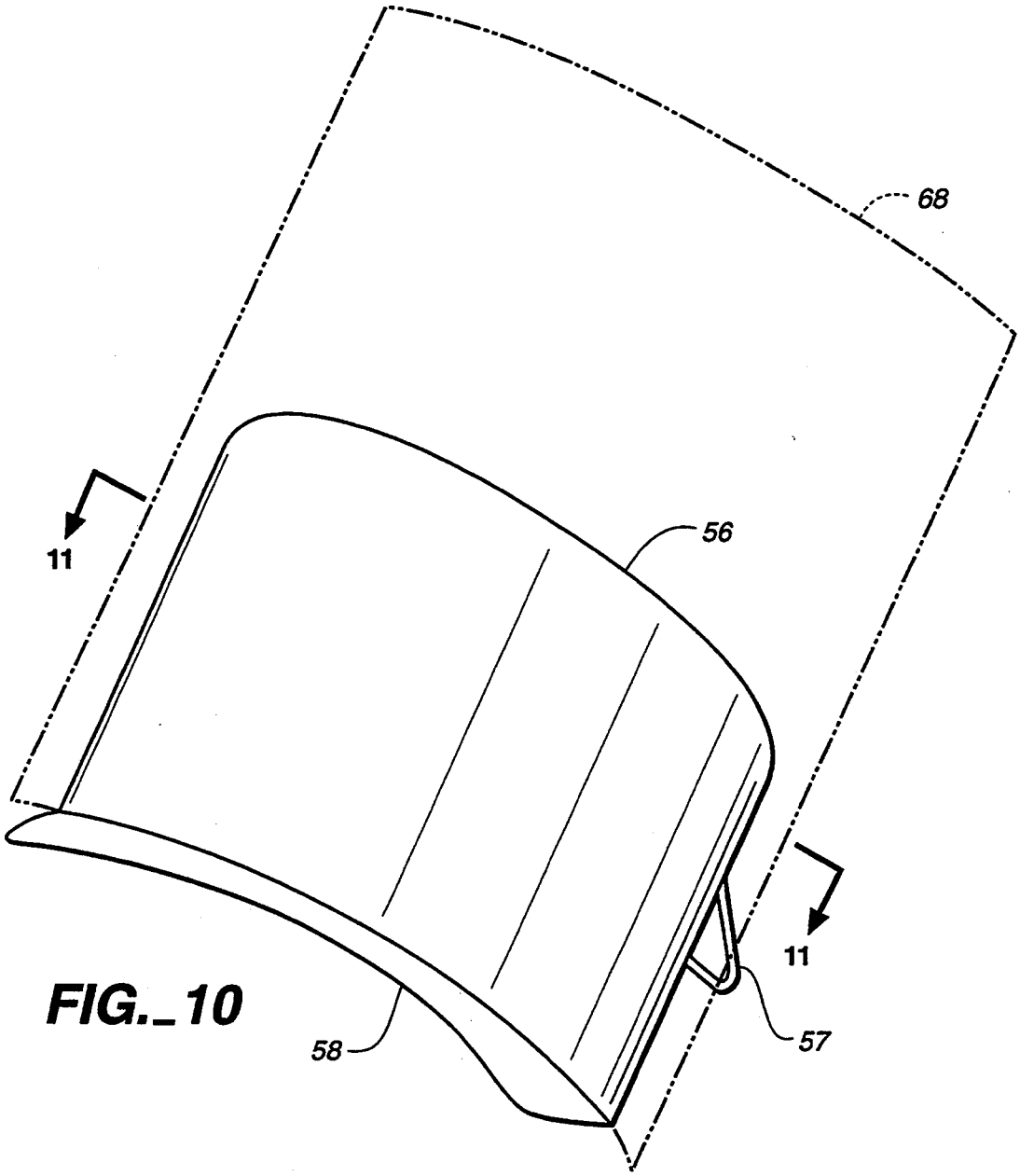

FIG. 10 is an isometric view of another embodiment of a document holder incorporating the invention.

Figure 11:
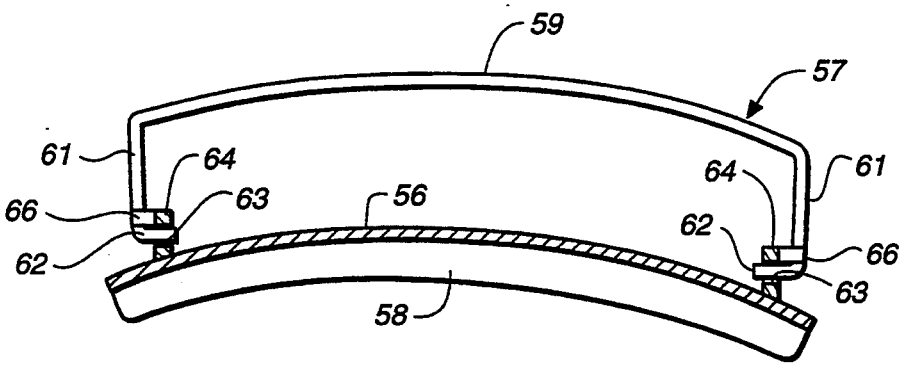

FIG. 11 is a horizontal sectional view taken along line 11—11 in FIG. 10.

Figure 12:
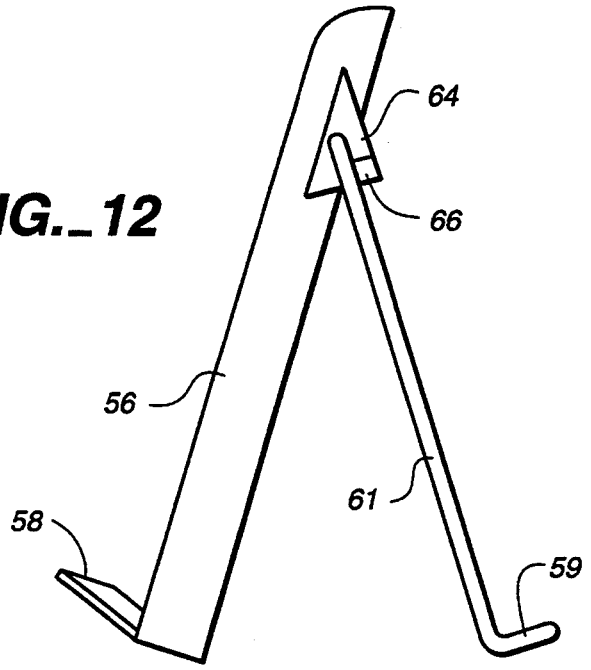

FIG. 12 is a side elevational view of the embodiment of FIG. 10.

Figure 13:
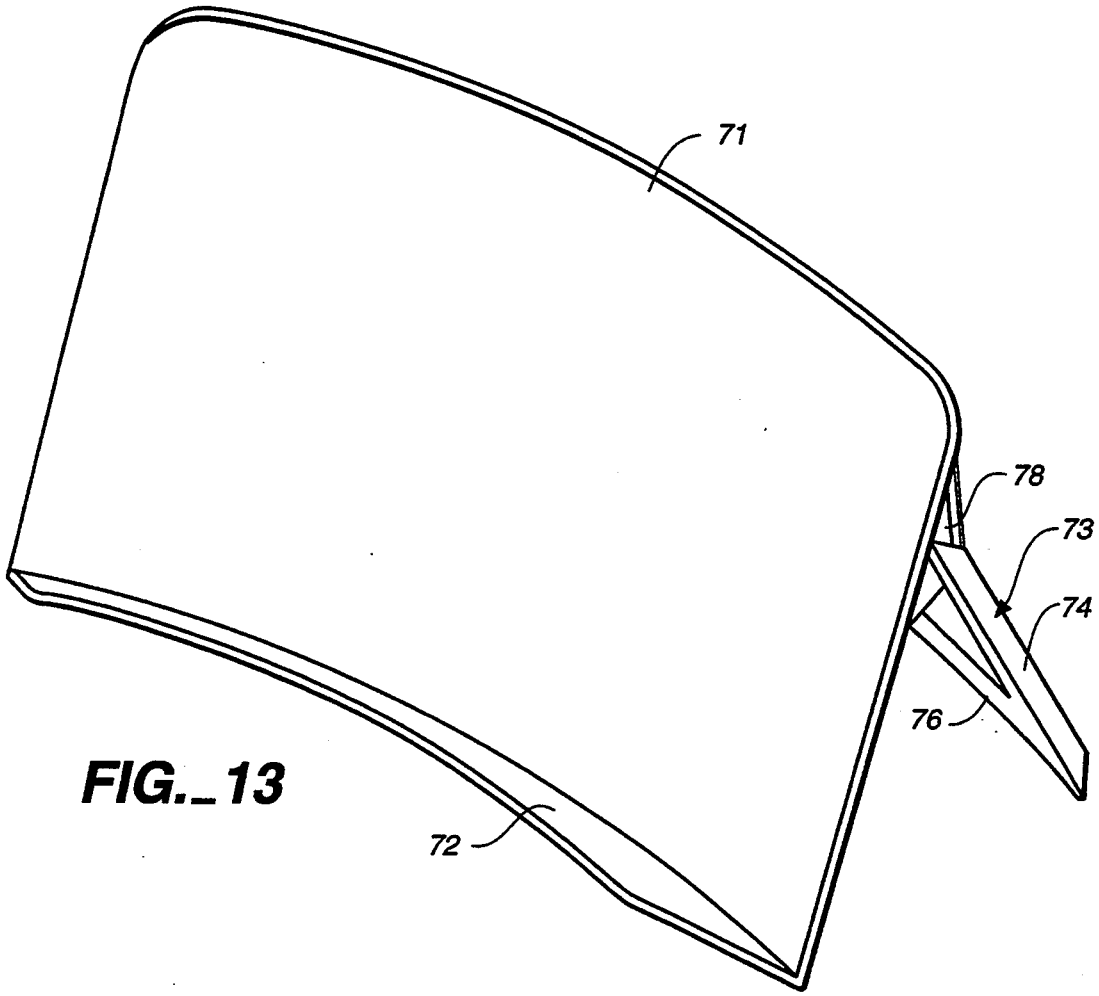

FIG. 13 is an isometric view of another embodiment of a document holder incorporating the invention.

Figure 14:
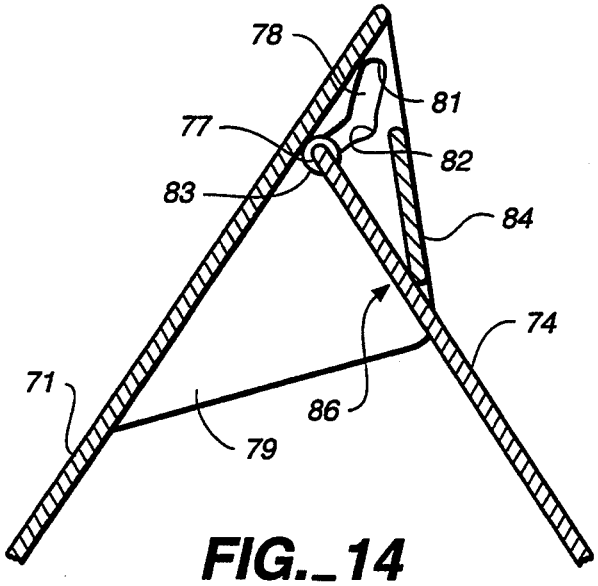
Figure 15:
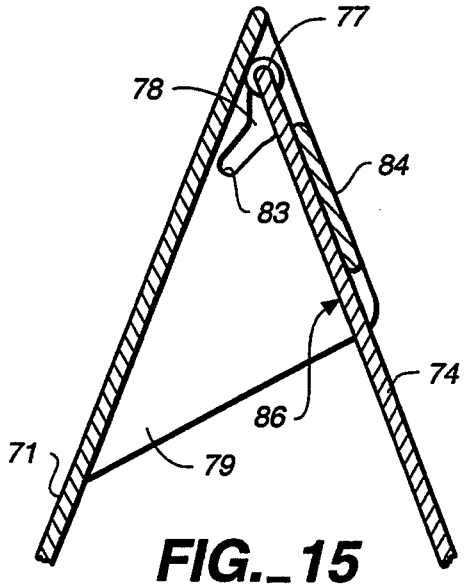

FIGS. 14 and 15 are fragmentary sectional views illustrating the embodiment of FIG. 13 in two different operational positions.

Figure 16:
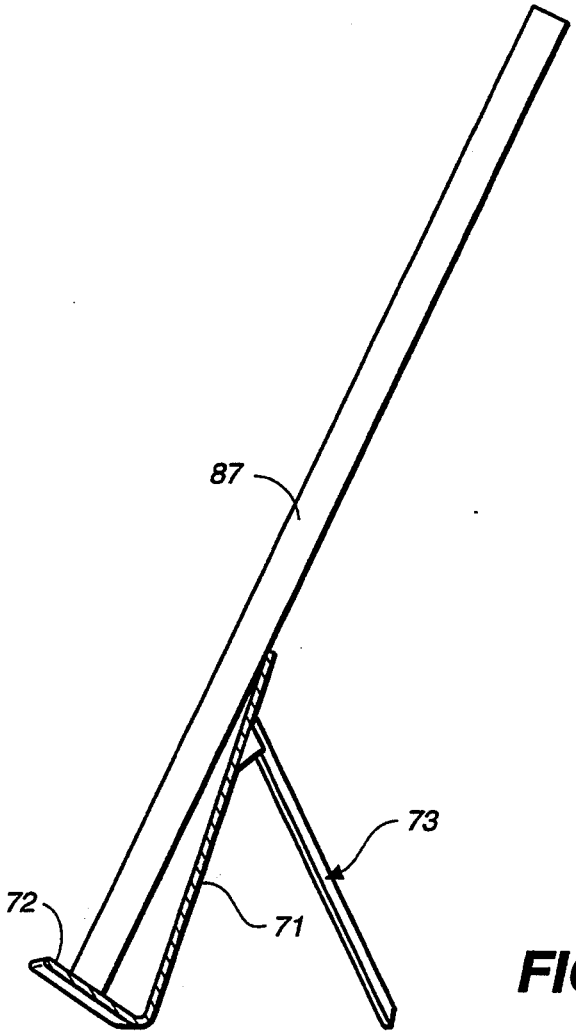

FIG. 16 is a vertical sectional view of the embodiment of FIG. 13 and a sheet of paper supported thereby.

Figure 17:
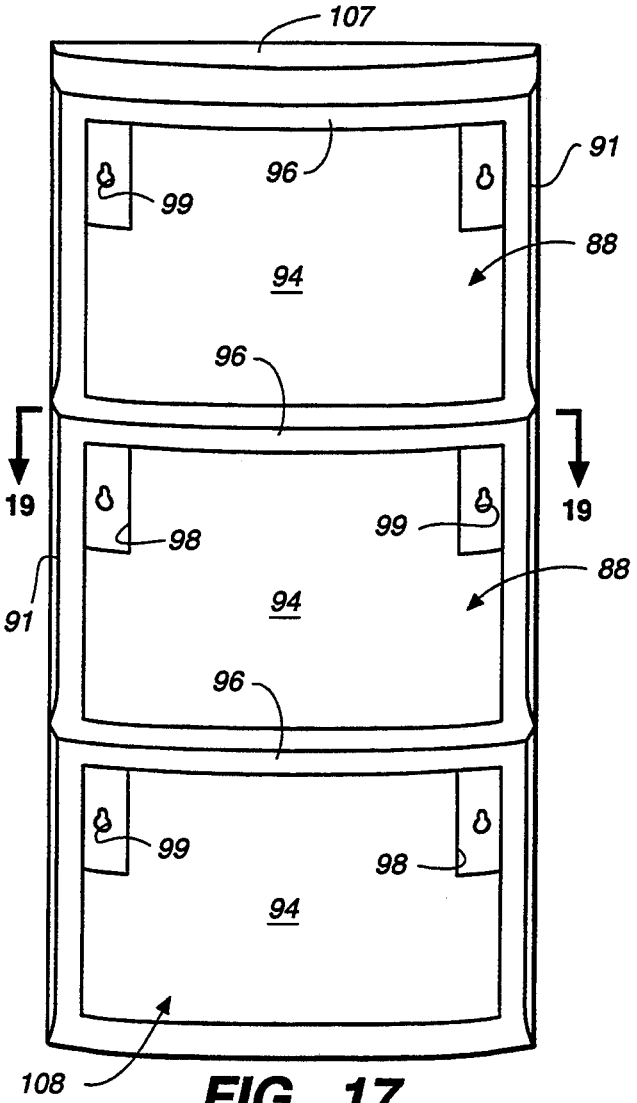

FIG. 17 is a front elevational view of another embodiment of a document holder according to the invention.

Figure 18:
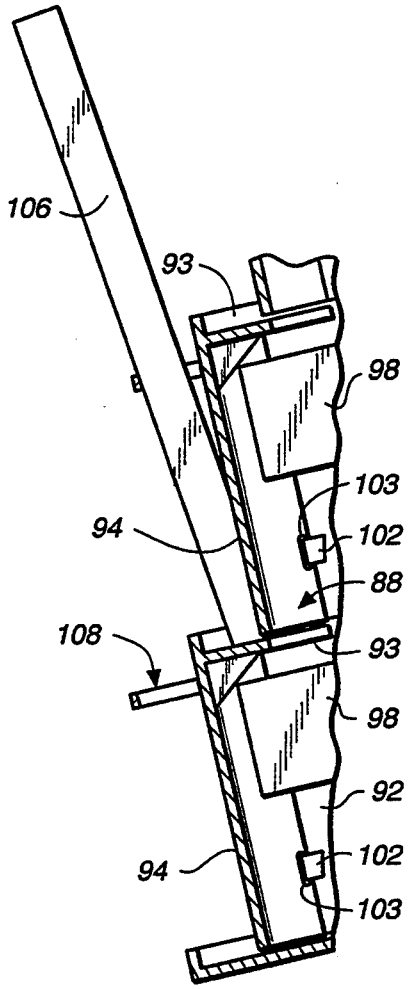

FIG. 18 is a fragmentary vertical sectional view of the embodiment of FIG. 17 holding a sheet of paper.

Figure 19:
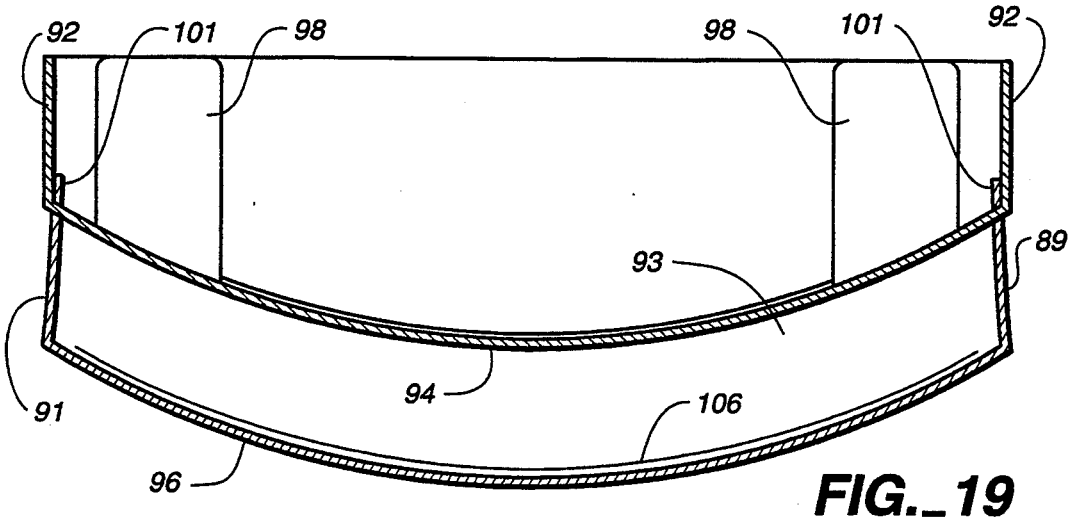

FIG. 19 is a cross-sectional view taken along line 19—19 in FIG. 17.

The embodiment illustrated in FIGS. 1–4 comprises a plurality of similar modular units 11 which are detachably connected together to form a rack suitable for mounting on a wall or other vertically extending support surface. Each of the modular units comprises a pocket-like member having a horizontally curved, generally rectangular outer wall or partition 12, and a pair of side flanges 13 which extend rearwardly from the lateral margins of the outer wall. A cross-member 14 extends horizontally between the side flanges on the back side of the outer wall about midway between the upper and lower margins of the outer wall and is rigidly affixed to the back side of the outer wall and to the inner sides of the side flanges. The upper portions 16 of the side flanges are generally rectangular in profile, with rear edges 17 which are generally parallel to the lateral margins of outer wall 12, and the lower portions 18 of the side flanges are tapered, with rear edges 19 which are inclined relative to the lateral margins of the outer wall. Cross-member 14 has a top flange 21 which is generally perpendicular to outer wall 12 and a rear flange 22 which depends from flange 21 and is aligned with the rear edge portions 19 of the side flanges. A mounting hole 24 is formed in flange 22 for receiving a mounting hook or other fastener whereby the rack can be attached to the wall or other supporting surface.

Figure 2:
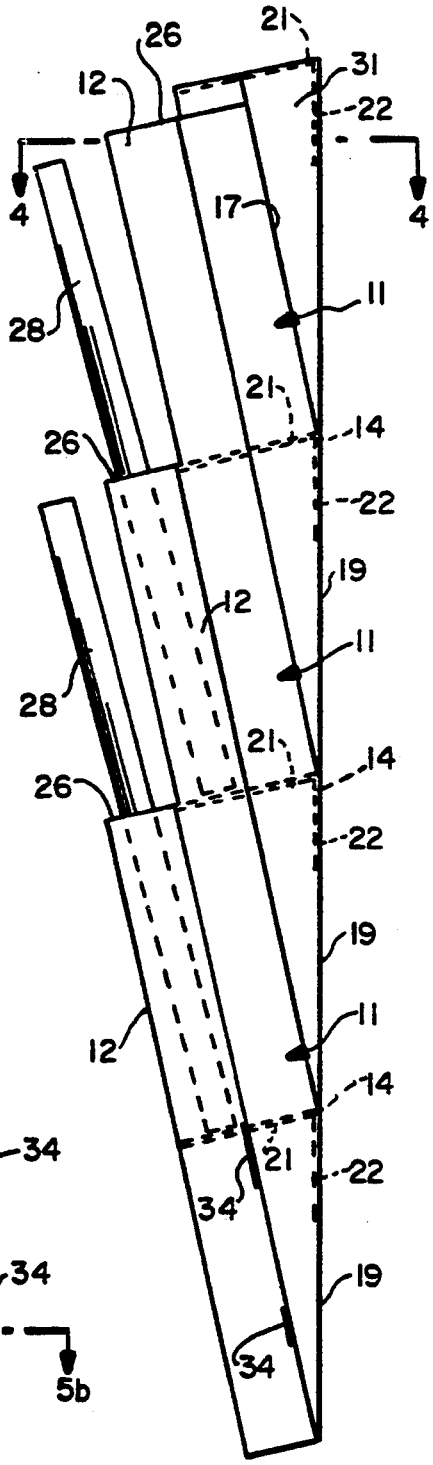
FIG. 2 is a side elevational view of the embodiment of FIG. 1 holding sheets of paper.
Figure 3:
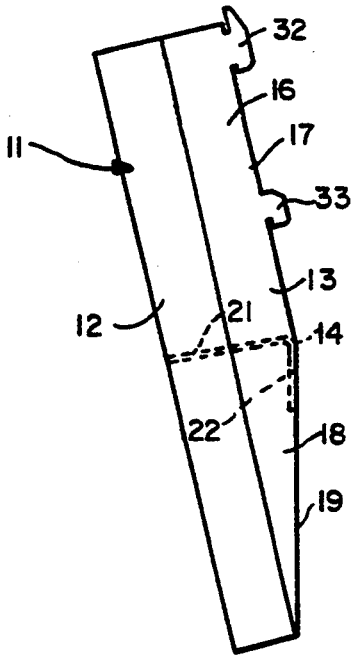
FIG. 3 is a side elevational view of one of the modular units which make up the document holder of FIG. 1.

Modular units 11 are connected together in overlapping fashion along a vertically extending axis with the upper edge of each outer wall being aligned generally opposite the top flange 21 of the cross-member of the next adjacent modular unit, and the upper rear edge portions 17 of side flanges 13 abutting against the lower portion of the outer wall of the next module. The outer walls of the adjacent modules are thus spaced apart in generally parallel relation to form the front and rear walls of paper holding compartments 26, with side flanges 13 and cross-member flanges 21 forming the side and bottom walls of the compartments. The lower rear edge portions 19 of side flanges 13 are aligned vertically for engagement with the wall or other mounting surface, and outer walls are inclined upwardly and outwardly as best seen in FIG. 2. The paper holding compartments are thus offset or spaced vertically, with the upper portions of papers 28 in one compartment being exposed and visible in front of the lower portion of the next compartment. Any desired number of modules can be employed to provide a corresponding number of compartments.

The upper modular section 31 of the embodiment of FIGS. 1–4 is generally similar to the other sections except it is truncated and terminates at the cross-member, with the top flange 21 of the cross-member serving as a decorative cap for the rack.

Outer walls or panels 12 have a nonlinear profile in horizontal section such that papers 28 placed in compartments 26 are constrained by the walls to a horizontally curved contour which converts rigidity to the papers and enables them to stand in the compartments without bending under their own weight. In the embodiment illustrated, the walls are arcuately curved, but they can have any suitable configuration which will confer rigidity to the papers.

Hook-like tabs 32, 33 project from the rear edges 17 of side flanges 13 and are received in slots 34 in the outer wall 12 of the next adjacent module to releasably secure the modules together in interlocking form. These connectors are engaged by inserting the tabs of one module into the slots of a second and moving the first module in a downward direction relative to the second. They are disengaged by moving the first module in an upward direction relative to the second and withdrawing the tabs from the slots.

FIGS. 5*a* and 5*b* illustrate alternative tabs 35, 36 for connecting the modular units together. Tabs 35 are employed at the upper rear corners of flanges 13, and tabs 36 are employed below. Tabs 35 project upwardly and rearwardly from the flanges and include a generally rectangular upper portion 37 and a rounded lower portion 38. These tabs are engaged by inserting upper portions 37 into slots 34 and rotating the module downwardly through an angle of 90° to position upper portions 37 behind the outer wall of the next adjacent module. Tabs 36 have laterally projecting shoulders 39 which engage the back side of the outer wall of the adjacent module when the tabs are inserted into the slots of that module. These connectors are disengaged by inwardly directed lateral pressure on the side flanges from which the tabs project.

Modular units 11 can be fabricated of any suitable rigid or semi-rigid material such as plastic, sheet metal or cardboard. Outer wall 12 and side flanges 13 are preferably formed as a unitary structure, and cross-member 14 can be affixed to the outer wall and the side flanges by any suitable means.

The embodiment illustrated in FIGS. 6–9 comprises a plurality of vertically stacked, generally circular modular units 41 mounted on a rotary base 42 to form a carousel rack. The base includes a platform or turntable 43 rotatively mounted on a stationary base 44 adapted to rest on a Counter or other horizontally extending support surface.

Each of the modular units 41 includes an upwardly and outwardly inclined frustaconical side wall 47 and a horizontally extending bottom wall 48. The side walls are spaced in overlapping fashion along a vertically extending axis, with the lower portion of the side wall of one module being positioned coaxially within the upper portion of the side wall of the next lower module and the bottom wall of the upper module being positioned midway between the upper and lower margins of the side wall of the lower module. The side walls of the adjacent modules are spaced apart to form paper holding compartments 49, with horizontally extending walls 48 forming the bottom walls of the compartments. As in the embodiment of FIGS. 1–4, paper holding compartments 49 are offset or spaced vertically, with the upper portions of papers 51 in one compartment being exposed and visible in front of the lower portion of the next higher compartment. Any desired number of modules can be employed to provide a corresponding number of compartments. Compartments 49 are generally annular in horizontal section and are adapted to hold a plurality of papers in side-by-side relation.

Walls 47, 48 are detachably connected together, and the entire rack is readily assembled and disassembled. In this regard, side walls 47 rest upon bottom wall 48 and have circumferentially spaced tabs 53 which project downwardly from the lower margins of the side walls and are received in slots 54 formed in the bottom walls. circumferentially spaced portions 56 of the outer peripheries of the bottom walls are received in interlocking, supportive relation between vertically spaced bosses 57 which project inwardly from the side walls. In the embodiment illustrated, the bosses are formed by forming inwardly extending oval shaped dimples in side wall and cutting slots across the dimples where the bottom walls are to be received.

Side walls 47 and bottom walls 48 are preferably fabricated of a relatively lightweight sheet material such as plastic or cardboard. The material of which side walls 47 are fabricated is preferably flexible enough to permit the side walls to be laid flat when the rack is disassembled, and the end portions of the sheets which form the side walls have interlocking tabs 59 which hold the side walls in their conical configuration when engaged. With the rack disassembled and the side walls laid flat, the side walls and bottom walls are readily stacked in a compact package for carrying or storage.

The lowermost section 61 of the embodiment of FIGS. 6–9 comprises a relatively short upwardly and outwardly inclined side wall 62 which rests upon platform 43, with interlocking tabs 63 projecting through slots 64 in the platform. Side wall 62 is approximately half as high as the side walls of the remaining sections, and it has a diameter corresponding to the diameter of the upper portions of the other side walls. Side wall 62 is positioned coaxially of the lower portion of the next adjacent side wall 47 which also rests upon platform 43, with its tabs 53 projecting through slots 66 in the platform. An additional paper holding compartment 67 is thus formed between side walls 62 and the next adjacent side wall 47, with platform 47 forming the bottom wall of this compartment.

A generally circular lid 68 having a depending peripheral flange 69 is mounted on side wall 47 of the uppermost section and serves as a decorative cap for the carousel rack. The space bounded by lid 68 and walls 47, 48 of the uppermost module can be used as a storage bin, if desired, with lid 68 forming a removable cover for this space. Likewise, the spaces enclosed by the remaining side walls and bottom walls can also be utilized for storage.

As in the embodiment of FIGS. 1–4, side walls 47, 62 have a nonlinear profile in horizontal section, and papers 51 placed in compartments 49, 67 are constrained by the side walls to a horizontally curved configuration which converts rigidity to the papers and enables them to stand in the compartments without bending under their own weight.

The embodiment of FIG. 10 is particularly suitable for use as a copy holder for a typist, a computer operator, or another person working from copy in the form of one or more loose sheets of paper.

The copy holder of FIG. 10 includes a backrest 56 which is held in an upwardly and rearwardly inclined position by a stand 57. A flange 58 extends in a forward direction from the lower edge of the backrest for receiving the lower edges of papers resting on the copy holder. The flange has a frustaconical curvature, with the convex side of the flange facing in an upward direction.

Backrest 56 has an upwardly concave curvature similar to that of the paper supporting walls in the other embodiments of the invention. As in the other embodiments, this curvature imparts a curvature to papers resting against the backrest, giving them a rigidity which enables them to stand in a generally upright position and extend a substantial distance above the backrest without buckling or collapsing under their own weight.

In the embodiment illustrated, stand 57 is a U-shaped wire stand with a base portion 59 adapted to rest on a supporting surface and a pair of upright arms 61 which are pivotally connected to the back side of the backrest. The upper end portions of the arms are bent toward each other to form pivot pins 62 which lie on a horizontally extending axis. The pivot pins are rotatively received in sockets 63 in vertically extending flanges 64 which project from the back side of the backrest, with stops 66 on the flanges limiting the rearward swing of the arms. Base portion 59 has a horizontal curvature corresponding to the curvature of the backrest so that the stand can rest tightly against the backrest in the closed position.

Flange 58 extends from backrest 56 at an angle somewhat less than 90° and is downwardly and rearwardly inclined toward the backrest when the copy holder is in use. With this inclination, the lower edges of papers resting on the copy holder tend to slide down the flange to the corner between the backrest and the flange and thus to conform to the curvature of the backrest. When a relatively tall paper, such as a newspaper, is resting on the copy holder, the upper edge of the backrest acts as a fulcrum, and the acute angle between the flange and the backrest prevents the paper from rotating about the fulcrum.

Although the backrest is inclined in the same direction as the walls which support the papers in the other embodiments of the invention, the papers are placed on the copy holder so that they face in the opposite direction than in the other paper holders. Thus, in the copy holder, the back sides of the papers are placed against the backrest or supporting wall, whereas in the other embodiments, the front sides of the papers rest against the supporting walls. Notwithstanding the direction the papers face, the operating principle is the same. The upwardly concave curvature of the supporting wall imparts an upwardly concave curvature to the papers. This curvature imparts a rigidity to the papers which enables them to extend a substantial distance above the supporting wall without bending over or collapsing under their own weight.

In use, the copy holder is placed on a desk or other supporting surface with the base portion of the stand and the outer corner between the backrest the paper supporting flange resting on the supporting surface. One or more sheets of paper 67 are placed on the copy holder, with the lower edges of the sheets resting on flange 57 and the back sides of the sheets resting against the front side of the backrest. As noted above, the upwardly concave curvature of the backrest imparts a corresponding curvature to the sheets of paper, giving them a rigidity which enables them to stand in a generally upright position and extend a substantial distance above the backrest without buckling or collapsing under their own weight. In the particular example illustrated in FIG. 9, the paper extends approximately twice as high as the supporting wall of backrest. The paper can also be wider than the backrest and still receive the curvature which imparts the rigidity to it.

The copy holder of FIG. 13 is similar to the embodiment of FIG. 10 and has a backrest 71 and a flange 72 similar to backrest 56 and flange 58. As in the embodiment of FIG. 10, the backrest is held in an upwardly and rearwardly inclined position by a stand 73, with flange 72 extending in upwardly and forwardly from the lower edge of the backrest. In this embodiment, however, the stand is adjustable to permit the backrest and papers held by the copy holder to be inclined at different angles.

Stand 73 has a pair of legs 74 and a lower cross member 76 which extends between the lower portions of the legs. The cross member has a curvature corresponding to that of the backrest, and the stand fits tightly against the back side of the backrest in its folded or closed position. In this embodiment, the stand is formed as a unitary structure of plastic, and cross bracing (not shown) is provided between the legs and the cross member to add rigidity to the stand. The curvatures of backrest 71, flange 72 and cross member 76 are such that when the copy holder is placed on a substantially level surface, only three points on the copy holder engage the surface-the outer corners of the legs and the midpoint of the lower edge of the backrest, thereby providing a stable, three-point support.

Stand 73 is pivotally connected to the backrest by means of pins 77 at the upper ends of legs 74 which are received in sockets 78 in mounting brackets 79 on the back side of the backrest. The mounting brackets have a generally triangular configuration and project rearwardly from the backrest. Each of the sockets 78 comprises a slotted opening having an upper detent area 81, a middle detent area 82 and a lower detent area 83 in which the pivot pin can be selectively positioned. A flange or stop 84 extends along the rear edge of each mounting bracket, and a detent bump 86 projects from the face of the bracket near the lower end of the flange, thereby forming a socket for holding the legs in the different positions. The legs are readily snapped into and out of the sockets over the detent bumps.

In FIG. 14, the backrest is illustrated in its most inclined position, with pivot pins 77 in lower detent areas 83 and legs 74 butting against the lower corners of stop flanges 84. The backrest is illustrated in its most upright position in FIG. 15, with pivot pins 77 in upper detent areas 81 and legs 74 lying flat against the stop flanges.

In FIG. 16, the copy holder of FIG. 13 is supporting a sheet of paper 87 which is substantially taller than the backrest. The backrest typically has a height on the order of five inches, and the sheet of paper might, for example, be a letter size sheet with a length of 11 inches, a legal size sheet with a length of 13 or 14 inches, or even a newspaper which typically has a height of 22 inches.

As in the embodiment of FIG. 10, when a sheet taller than the backrest is placed in the copy holder, the bottom edge of the sheet rests upon the central portion of the upwardly convex flange 72, and the sheet rests against the backrest with the only contact between the sheet and the backrest being along the upper edge of the backrest. The sheet is thus supported in a cantilevered fashion, with the upper edge of the backrest serving as a fulcrum and imparting an upwardly concave curvature to the sheet. This curvature confers a rigidity to the sheet throughout its entire length, which enables the sheet to stand in an upright position without buckling under its own weight, even though it may extend unsupported above the backrest as much as three or four times the height of the backrest.

Any tendency of the sheet to rotate about the fulcrum at the upper edge of the backrest is resisted by the weight of the sheet acting on the inclined flange 72 and by frictional engagement between the lower edge of the sheet and the upper surface of flange.

In practice, the stiffness or rigidity imparted to the sheets is so great that the height of the sheets which can be supported is not limited by buckling of the sheets but rather by tipping of the copy holder when the sheets get so high that the center of gravity shifts so far to the rear that the copy stand and the portion of the sheets below the fulcrum point no longer have sufficient weight to offset the tipping moment.

The embodiment of FIG. 17 is generally similar to that of FIG. 1 except that the stiffening curvature is imparted to the papers in each pocket or compartment by a single ribbon or wire-like element rather than a wall or backrest as in the other embodiments.

As in the embodiment of FIG. 1, the embodiment of FIG. 17 is constructed in modular form from a plurality of units which can be connected together to form a paper holder with any desired number of pockets or compartments. In the embodiment of FIG. 17, the basic module 88 has a pair of side walls 89 each of which has a rectangular upper section 91 and a triangular lower section 92, with a cross member 93 extending between the side walls at the junctions of the upper and lower sections. Each module also has a curved front wall 94 which extends between the lower sections of the side walls and a curvilinear element 96 which extends between the upper portions of the side walls. Cross member 93 projects rearwardly from front wall 94 at an angle of approximately 90°, with a gusset 97 between the front wall and the cross member.

A pair of sockets 98 are formed in the front wall of each module, with mounting holes 99 in the rear walls thereof for receiving mounting screws (not shown) for affixing the paper holder to a wall or other vertical support. The sockets project rearwardly from the front wall, with the rear walls of the sockets aligned in a plane with the rear edges of the triangular lower sections of side walls 89.

Each module also has hook-like tabs 101, 102 similar to tabs 35, 36 of FIGS. 5*a* and 5*b* which project rearwardly from the upper sections of the side walls and are received in slotted openings 103 in the front wall of the next higher module to secure the units together.

In the embodiment of FIG. 17, cross members 93 form the bottom walls of the paper holding pockets or compartments, and papers 106 placed in the pockets lean against the curvilinear elements 96 just as they lean against the upper edge portions of the upwardly concave walls in the other embodiments. The curvilinear elements impart an upwardly concave curvature to the papers which stiffens them and enables them to stand without buckling, as in the other embodiments.

The curvilinear elements are spaced above the cross members by a distance no greater than about one-half the length of the papers to be held by the display. Thus, for example, in one presently preferred embodiment for holding $8\frac{1}{2} \times 11$ inch sheets, the curvilinear element is $5\frac{1}{8}$ inches above the cross member. When the modular units are assembled together, the cross member of each unit is positioned approximately $\frac{1}{4}$ inch above the curvilinear element of the next lower unit.

With the curvilinear elements spaced less than half the length of the papers above the bottom walls of the pockets, the curvilinear elements engage the under sides of the leaning papers in fulcrum-like fashion below the vertical centerlines of the papers, and the upper portions of the papers are supported in cantilevered fashion above the pockets. With more than half of each sheet of paper positioned above the fulcrum, the papers have a tendency to rotate about the fulcrum in the direction in which they are leaning. Such rotation is prevented, however, by frictional engagement between the lower edges of the papers and the cross members on which they rest. Thus, the papers stand erect, leaning firmly against the curvilinear elements and stiffened by the curvature imparted to them by those elements.

In the event that a paper placed in one of the pockets is so long that the frictional engagement with the cross member is unable to hold the paper against rotation due to the weight above the fulcrum, the lower portion of the paper will engage the front wall of the next higher module at the rear of the pocket to prevent further rotation, and the paper will stand erect in that position with the stiffness produced by the curvature imparted by the curvilinear element.

The embodiment of FIG. 17 also has an upper module 107 and a lower module 108 which are generally similar to the lower and upper sections of modules 88, respectively.

In one presently preferred embodiment, each of the modular units is formed as a unitary structure of semi-rigid plastic by a molding process, and in the embodiment illustrated, curvilinear element 96 is a ribbon-like element which has a height or width on the order of $\frac{3}{8}$ inch. This element can, however, have a greater or lesser dimension, and it can also be in the form of a single strand such as a wire or even a flexible element, such as a string, since a flexible element will assume the desired curvature when the papers lean against it.

It is apparent from the foregoing that a new and improved document holder has been provided. While only certain presently preferred embodiments have been described in detail, as will be apparent to those familiar with the art, certain changes and modifications can be made without departing from the scope of the invention as defined by the following claims.

I claim:

1. A document display comprising: a supporting surface, a flexible sheet of paper standing upright on the supporting surface, and a curvilinear element spaced above the supporting surface by a distance no greater than one-half the length of the paper, with the paper leaning against the curvilinear element in fulcrum-like fashion and thereby being imparted with a curvature which enables the paper to extend unsupported with at least one-half its length above the fulcrum without buckling under its own weight, and frictional engagement between the lower edge of the paper and the supporting surface holding the lower edge in a fixed position so the paper does not rotate about the fulcrum due to the weight of the paper above the fulcrum.

2. The document display of claim 1 wherein the curvilinear element comprises the upper edge portion of a horizontally curved vertically extending wall.

3. The document display of claim 1 wherein the curvilinear element comprises a horizontally extending wire-like element.

4. The document display of claim 3 wherein the wire-like element is flexible.

5. The document display of claim 1 wherein the paper has front and rear surfaces, and the curvilinear element engages the front surface of the paper.

6. The document display of claim 1 wherein the paper has front and rear surfaces, and the curvilinear element engages the rear surface of the paper.

7. A document display comprising: a vertically inclined wall having an upwardly concave surface, a flange extending along a lower edge of the wall and projecting in an upwardly inclined direction from the concave surface, and a flexible sheet of paper having a length on the order of at least twice the height of the wall resting on the flange and leaning against the wall in a vertically inclined position, with a central portion of the sheet resting against the upper edge portion of the wall, the lower portion of the sheet being spaced away from the wall and the portion of the sheet above the wall having an upwardly concave curvature and a rigidity which enables the sheet to stand without buckling, and frictional engagement of the sheet with the inclined flange preventing the sheet from rotating about the upper edge portion of the wall due to the weight of the sheet above the wall.

8. A document display comprising: a vertically inclined wall having an upwardly concave surface, a flange extending along a lower edge of the wall and projecting in an upwardly inclined direction from the concave surface, said flange having a frustaconical curvature with the convex side of the flange facing in an upward direction, and a flexible sheet of paper having a length on the order of at least twice the height of the wall resting on the flange and leaning against the wall in a vertically inclined position, with a central portion of the sheet resting against the upper edge portion of the wall, the lower portion of the sheet being spaced away from the wall and the portion of the sheet above the wall having an upwardly concave curvature and a rigidity which enables the sheet to stand without buckling, and frictional engagement of the sheet with the inclined flange preventing the sheet from rotating about the upper edge portion of the wall due to the weight of the sheet above the wall.

9. In a document holder for displaying a flexible sheet of paper in a generally upright position: a vertically inclined wall having an upwardly concave surface and a height substantially less than the length of the sheet of paper, and a frustaconically curved flange extending along the lower edge of the wall and having an upwardly facing convex side projecting in an upwardly inclined direction from the concave surface for receiving the lower edge of the sheet of paper, with the sheet leaning against the wall and extending unsupported a substantial distance above the wall with an upwardly concave curvature which confers rigidity to the portion of the sheet above the wall and enables it to stand without buckling under its own weight.

10. The document holder of claim 9 wherein the vertically inclined wall comprises a backrest having a laterally concave surface and a stand for holding the backrest in a vertically inclined position with the concave surface facing in an upward direction.

11. The document holder of claim 10 wherein the stand is pivotally connected to the backrest.

12. In a document holder for holding a flexible sheet of paper in a generally upright position: a backrest having a concave lateral curvature and a height substantially less than the length of the sheet of paper, a stand for holding the backrest in a vertically inclined position with the concave curvature facing in an upward direction, and a frustaconically curved flange extending laterally across the lower portion of the backrest and having an upwardly facing convex side projecting from the concave side of the backrest at an acute angle for receiving a lower edge of a sheet of paper resting against the concave side of the backrest.

13. In a document holder for holding flexible sheets of paper in a generally upright position: first and second modular units each having a vertically inclined wall with an upwardly concave curvature and a height substantially less than the length of a sheet of paper for supporting the sheet in such manner that the sheet rests against the wall in a vertically inclined position and extends unsupported a substantial distance above the wall with an upwardly concave curvature which confers rigidity to the portion of the sheet above the wall and enables the sheet to stand without buckling under its own weight, upper and lower pairs of vertically extending slots formed in a forwardly facing wall of the first modular unit, and upper and lower pairs of hook-like tabs projecting from the second modular unit for engagement with the slots in the first unit to hold the two units together, each of the hook-like tabs in the upper pair having a generally rectangular upper portion and a rounded lower corner and being adapted for engagement with the associated slot by inserting the rectangular portion into the slot and rotating the module downwardly through an angle of approximately 90° to position the upper portion behind the wall.

14. In a document holder for holding flexible sheets of paper in a generally upright position: first and second modular units each having a vertically inclined wall with an upwardly concave curvature and a height substantially less than the length of a sheet of paper for supporting the sheet in such manner that the sheet rests against the wall in a vertically inclined position and extends unsupported a substantial distance above the wall with an upwardly concave curvature which confers rigidity to the portion of the sheet above the wall and enables the sheet to stand without buckling under its own weight, upper and lower pairs of vertically extending slots formed in a forwardly facing wall of the first modular unit, and upper and lower pairs of hook-like tabs projecting from the second modular unit for engagement with the slots in the first unit to hold the two units together, each of the hook-like tabs in the lower pair having a laterally projecting shoulder for engagement with the back side of the wall adjacent to one of the slots.

15. A document display comprising: a flexible sheet of paper standing in a vertically inclined position, a curvilinear element engaging the under side of the paper in fulcrum-like fashion along a horizontally extending line no higher than the vertical centerline of the paper and imparting an upwardly concave curvature to the paper with at least half of the paper extending unsupported above the fulcrum, and means for retaining the lower portion of the paper in a fixed position so that the paper does not rotate about the fulcrum due to the weight of the paper above the fulcrum.

16. The document display of claim 15 wherein the curvilinear element comprises the upper edge portion of a horizontally curved vertically extending wall.

17. The document display of claim 15 wherein the curvilinear element comprises a horizontally extending wire-like element.

18. The document display of claim 17 wherein the wire-like element is flexible.

19. In a document holder for holding a plurality of papers in a generally upright position: a rotary base rotatable about a vertically extending axis, a first upwardly and outwardly inclined frustaconical side wall mounted on the base and positioned coaxially of the vertically extending axis, a horizontally extending wall positioned midway between the upper and lower margins of the first side wall, and a second upwardly and outwardly inclined frustaconical side wall resting on the horizontally extending wall and being disposed coaxially of and spaced radially inward from the first side wall to form a paper holding compartment having an annular profile in horizontal section for receiving a plurality of papers in side-by-side relation and constraining said papers to an upwardly and outwardly inclined, outwardly curved configuration which confers rigidity to the papers and enables them to stand in a generally upright position and extend a substantial distance above the first side wall without bending under their own weight, the side walls and the horizontally extending wall being releasably joined together in a manner permitting ready assembly and disassembly of the document holder, with the side walls being fabricated of sheets of flexible material which lie flat when the document holder is disassembled and have interlocking tabs at the end portions thereof which hold the sheets in a circular configuration when engaged.

20. In a document holder for holding a plurality of papers in a generally upright position: a rotary base rotatable about a vertically extending axis, a first upwardly and outwardly inclined frustaconical side wall mounted on the base and positioned coaxially of the vertically extending axis, a horizontally extending wall positioned midway between the upper and lower margins of the first side wall, and a second upwardly and outwardly inclined frustaconical side wall resting on the horizontally extending wall and being disposed coaxially of and spaced radially inward from the first side wall to form a paper holding compartment having an annular profile in horizontal section for receiving a plurality of papers in side-by-side relation and constraining said papers to an upwardly and outwardly inclined, outwardly curved configuration which confers rigidity to the papers and enables them to stand in a generally upright position and extend a substantial distance above the first side wall without bending under their own weight, the side walls and the horizontally extending wall being releasably joined together in a manner permitting ready assembly and disassembly of the document holder, with circumferentially spaced outer portions of the horizontally extending wall being received in interlocking, supportive relationship between vertically spaced bosses which project inwardly from the first side wall.

21. The document holder of claim 20 wherein the bosses are formed by forming circumferentially spaced horizontally extending slots of limited length in the first side wall, and bending portions of the wall in an inward direction above and below the slots.

22. In a document holder for holding a plurality of papers in a generally upright position: a rotary base rotatable about a vertically extending axis, a first upwardly and outwardly inclined frustaconical side wall mounted on the base and positioned coaxially of the vertically extending axis, a horizontally extending wall positioned midway between the upper and lower margins of the first side wall, and a second upwardly and outwardly inclined frustaconical side wall resting on the horizontally extending wall and being disposed coaxially of and spaced radially inward from the first side wall to form a paper holding compartment having an annular profile in horizontal section for receiving a plurality of papers in side-by-side relation and constraining said papers to an upwardly and outwardly inclined, outwardly curved configuration which confers rigidity to the papers and enables them to stand in a generally upright position and extend a substantial distance above the first side wall without bending under their own weight, the side walls and the horizontally extending wall being releasably joined together in a manner permitting ready assembly and disassembly of the document holder, with the second side wall being secured to the bottom wall by tabs which project from the side wall and are received in slots formed in the bottom wall.

* * * * *